United States Patent [19]

Johnson

[11] 4,189,123

[45] Feb. 19, 1980

[54] LOCKING MODULAR ASSEMBLY

[76] Inventor: Bernard L. Johnson, 183 Rubicon Cir., Danville, Calif. 94526

[21] Appl. No.: 881,111

[22] Filed: Feb. 24, 1978

[51] Int. Cl.[2] ..... A47B 57/16; A47B 47/00

[52] U.S. Cl. ..... 248/220.2; 52/36; 108/108; 211/187; 248/222.2; 248/243

[58] Field of Search ..... 108/108, 110, 144, 152; 248/220.2, 222.1, 222.2, 243; 211/187, 190, 192, 208; 52/36

[56] References Cited

U.S. PATENT DOCUMENTS

| | | | |
|---|---|---|---|
| 2,971,805 | 2/1961 | Weiss | 248/220.2 X |
| 3,353,684 | 11/1967 | Chesley | 248/243 X |
| 3,565,381 | 2/1971 | Oliver | 248/243 |
| 3,966,158 | 6/1976 | Boundy | 248/243 |
| 4,013,254 | 3/1977 | Boundy et al. | 248/243 |
| 4,031,675 | 6/1977 | Roberts et al. | 52/36 |

FOREIGN PATENT DOCUMENTS

| | | | |
|---|---|---|---|
| 779813 | 3/1968 | Canada | 211/187 |

*Primary Examiner*—William E. Lyddane
*Attorney, Agent, or Firm*—Michael D. Nelson

[57] ABSTRACT

An improved modular wall or shelf assembly is disclosed which may be locked into place. The assembly comprises an upright support for supporting the modular wall or shelf component and a mounting bracket connected to the modular wall or shelf component along a vertical plane for adjustably affixing the modular wall or shelf component to the upright support. The mounting bracket is composed of two parts, namely an upper bracket member and a lower bracket member. The upper bracket has an elongated body portion which is adapted to be connected to the upper portion of the modular wall or shelf component and a plurality of linearly aligned tabs. The tabs extend outwardly and each have a horizontal lower lip for supporting the vertical load of the modular component. All of the tabs, except the uppermost tab, have an upper lip which extends horizontally or downwardly. The uppermost tab has an upper lip which has an upwardly projecting finger adapted to communicate with the upright support and to prevent lateral displacement of the top portion of the modular wall or shelf component. The lower bracket has a shortened body portion and at least one linearly aligned tab. These tabs are the same as the tabs on the upper bracket with the uppermost tab having the upwardly projecting finger. The lower bracket is adapted to be connected to the lower portion of the wall or shelf component and when connected locks the wall or shelf component to the upright support.

8 Claims, 13 Drawing Figures

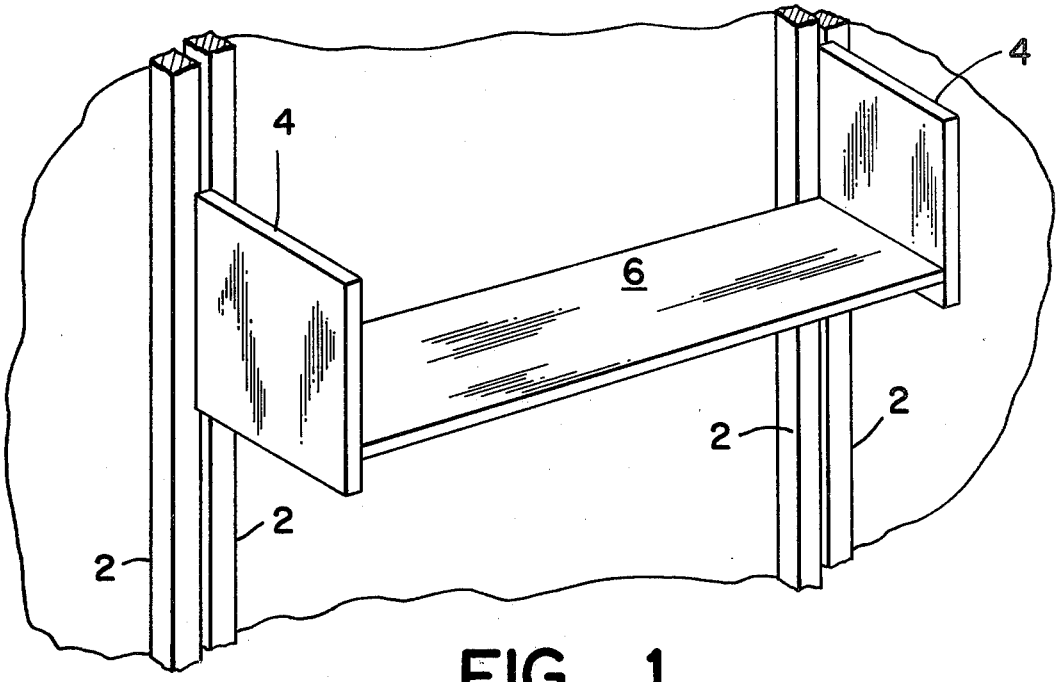
FIG_1
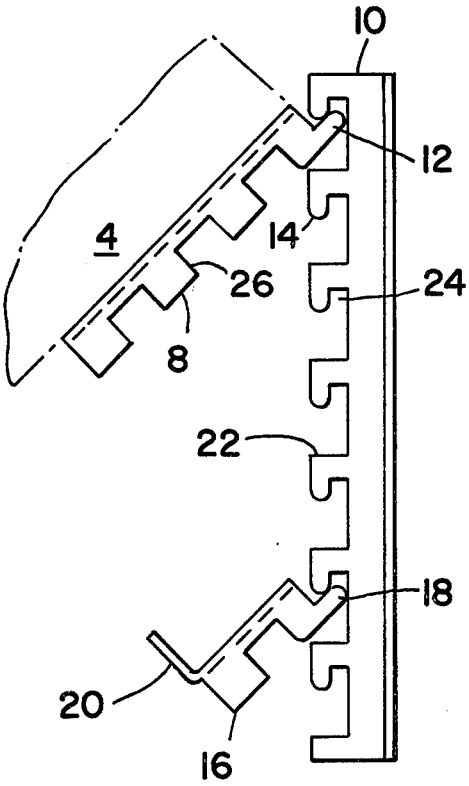
FIG_2
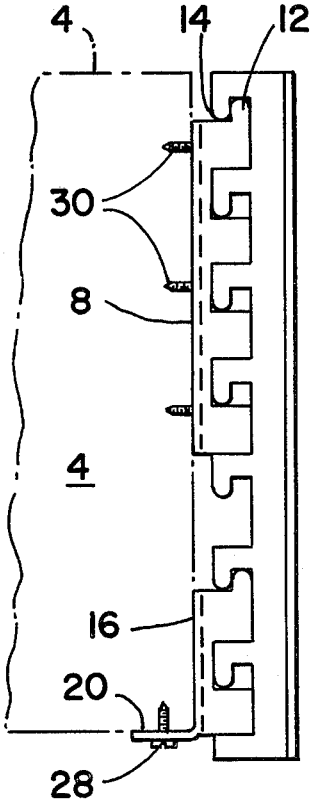
FIG_3
FIG_4
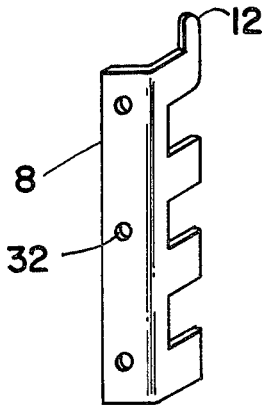
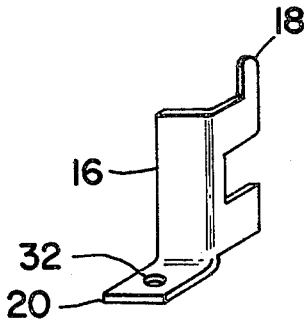
FIG_5

LOCKING MODULAR ASSEMBLY

BACKGROUND OF THE INVENTION

Modular walls and shelf assemblies are becoming more and more prevalent in offices and particularly open offices. In the traditional open office, the typists would be given a desk among many others in an open area. The work noise from one typist would interfere with the efficiency of the others and visa versa. The enclosure of each work area into a separate room would eliminate the noise problem, but would cost more than the increase in efficiency and would consume too much space.

Another problem associated with the traditional system is that of improper desk height. Typically an employer will purchase all of the desks for the typists at one time. These desks will usually be of a standard size which may not be adjusted. The typist is expected to adjust her chair height to fit the desk. For tall typists this often results in backaches and the like. For short typists the elevated chair many times reduces the circulation to the typist's legs. These problems reduce the typist's efficiency and work product.

Modular wall and shelf assemblies have alleviated many of the problems associated with the traditional office. Sound deadening portable partition walls may be erected around each work area thereby giving some privacy to each typist. Work stations can be attached to the portable partition walls and adjusted to the proper height for each typist. Upon changing typists the work station may be quickly and easily adjusted to fit the newcomer.

Although the use of modular wall and shelf assemblies have greatly improved the work efficiency and comfort of the work force, it has caused other problems. For example, the typical modular wall or shelf bracket is disclosed in Weiss, U.S. Pat. No. 2,971,805. The bracket has cantilevered hooked arms aligned vertically along one edge. The cantilevered hooked arms fit into a support plate consisting of a slotted standard (See U.S. Pat. No. 3,966,158) or a counter notched plate positioned between two frames.

One problem which exists with this type of bracket construction is that of safety. The modular walls and shelfs are erected by sliding the hooked arms of the bracket into the slotted or notched support and then forcing the bracket downwardly against the support. This downward movement sets the bracket. If the modular wall or shelf is jarred, the hooked arms can dislodge and the wall or shelf component collapses. This is particularly problemsome with work stations and shelves since an upwardly jarring force is common.

Another problem associated with the typical modular wall and shelf assembly is the large vertical and lateral forces between the hooked arms of the bracket and the slotted or notched support plate. The conventional hook and support plate requires the manufacture of arm thickness to be sufficient to permit the hook portion to pass through the slotted or notched support plate. This reduces the effective thickness capable of being employed and therein reduces the total load ability of the modular system.

OBJECTS OF THE INVENTION

It is an object of this invention to provide an improved modular wall or shelf assembly.

It is an additional object of this invention to provide an improved bracket for a modular wall or shelf assembly.

It is a further object ot his invention to provide a locking bracket for a modular wall or shelf assembly.

It is a still further object of this invention to provide a locking bracket for use in a modular wall or shelf assembly which is easy to manufacture and use and which is inexpensive to make.

Other objects of this invention will become apparent from the following description and appended drawings.

SUMMARY OF THE INVENTION

I have found that the aforegoing objects and their attendant advantages may be realized by a modular wall or shelf assembly comprising an upright support means for supporting a modular wall or shelf component in a substantially upright position and a mounting bracket means. The mounting bracket means is connected to said modular wall or shelf component along a vertical plane extending from the top to the bottom of said modular wall or shelf component for adjustably affixing the modular component to the support means. The mounting bracket means is comprised of:

(a) an upper bracket member having an elongated body portion constructed to be connected to the upper portion of said modular wall or shelf component, and a plurality of linearly aligned first tabs extending outwardly from said body portion. The tabs have a substantially horizontal lower lip to support the vertical load of said modular component and a horizontal or downwardly extending upper lip on all tabs except the uppermost tab. The uppermost tab has a horizontal lower lip and an upwardly projecting finger on the upper lip adapted to communicate with the upright support means. This finger is used to prevent lateral displacement of the top portion of the modular wall or shelf component.

(b) a lower locking bracket member having a shortened body portion and at least one linearly aligned tab extending outwardly from the body portion. The uppermost tab has a substantially horizontal lower lip and an upwardly projecting finger on the upper lip adapted to communicate with said upright support means to prevent lateral displacement of said lower locking bracket member. The shortened body portion is constructed to be connected to the lower portion of said modular wall or shelf component thereby locking said modular wall or shelf component to said upright support means.

BRIEF DESCRIPTION OF THE DRAWINGS

The references to numbered characters in the drawings refer to parts or features of one embodiment of this invention with the same numbered characters in the several figures referring to corresponding parts or features.

In the drawings:

FIG. 1 is a perspective view of the modular wall or shelf assembly of this invention.

FIG. 2 is a cross-sectional side view of the upper and lower brackets being inserted into the support plate.

FIG. 3 is a cross-sectional side view of the upper and lower brackets fully mounted in the support plate.

FIG. 4 is a perspective view of the upper bracket of this invention.

FIG. 5 is a perspective view of the lower locking bracket of this invention.

DETAILED DESCRIPTION OF THE INVENTION

Figure 6:
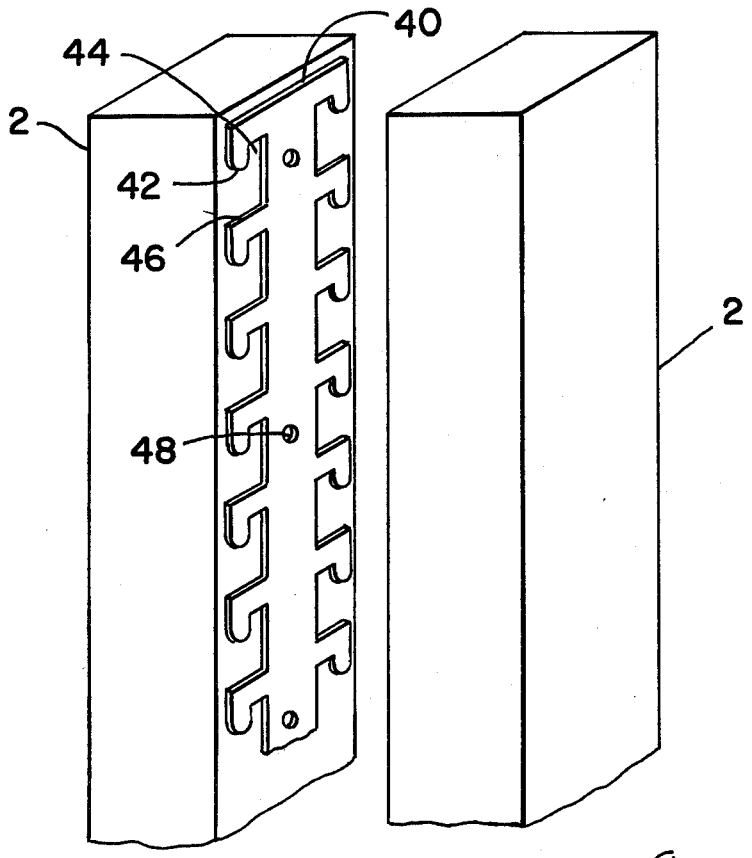
FIG. 6 is an exploded perspective view of a two sided support plate between two support posts of this invention.
Figure 7:
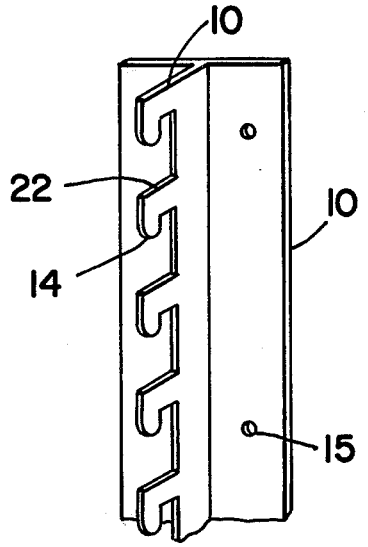
FIG. 7 is a perspective view of a single-sided support plate.

A specific embodiment of the modular components of this invention is illustrated in the accompanying drawings. FIG. 1 displays a modular shelf 6 connected to modular wall components 4. The modular wall components 4 are connected to upper bracket 8 and lower bracket 16. These brackets are composed of a body portion and a plurality of outwardly extending rectangular tabs. Each tab has a flat horizontal lower lip and a flat horizontal upper lip 26. The uppermost tab on both the upper and lower brackets each have an upwardly projecting finger 12 and 18 respectively.

The upper bracket 8 and lower bracket 16 fit into support plate 10. Support plate 10 is composed of a body portion which is sandwiched between support posts 2. The posts 2 are connected to support plate 10 by screws which pass through holes 15. The support plate 10 has linearly disposed L-shaped counter-tabs spaced at regular intervals so as to receive the rectangular tabs of the upper and lower brackets 8 and 16.

The counter-tabs have downwardly projecting counter-fingers 14 adapted to receive the complementary fingers 12 and 18 on the uppermost tabs of the upper and lower brackets 8 and 16. These downwardly projecting counter-finger 14 are provided to prevent the lateral displacement of the component wall or shelf components when fully assembled. The L-shaped counter-tabs are further constructed so that each counter-tab has a horizontal upper support surface 22. The flat horizontal lower lip of the tabs in the upper and lower brackets 8 and 16 rest upon the horizontal support surface 22 of the counter-tabs and transfer all of the vertical load from the modular wall component 4 into the support plate 10 and support posts 2.

The modular wall component 4 is fastened to the upper brackets by screws 30 which pass through holes 32 in the body portion of the upper bracket 8. The lower bracket is connected to modular wall component 4 by passing screw 28 through hole 32 in support lip 20.

Figure 8:
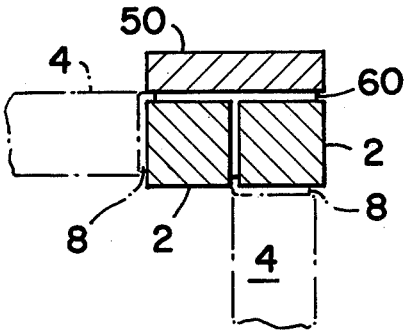
FIG. 8 is a cross-sectional top view of a three sided support plate between three support posts and two phantom wall components.
Figure 9:
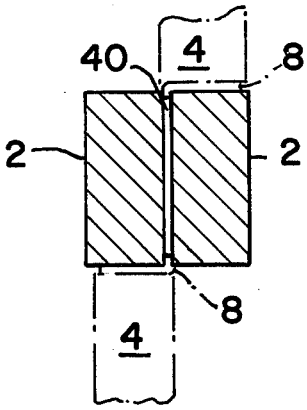
FIG. 9 is a cross-sectional top view of a two sided support plate as shown in FIG. 6 between two support posts and two phantom wall components.

FIGS. 6 and 8 through 13 illustrate alternative support plates which may be employed in the practice of this invention. For example, a wall or shelf assembly having a wall or shelf component capable of being mounted on opposite sides of the support posts is illustrated in FIGS. 6 and 9. As shown, two sided support plate 40 is sandwiched between support posts 2. Bolts pass through posts 2 and through hole 48 in plate 40 to keep the posts 2 tightly adjacent the plate 40. These posts prevent transverse displacement of the upper and lower brackets 8 and 16 when mounted within the support plate. The support plate has linearly disposed L-shaped counter-tabs spaced at regular intervals so as to provide vertical adjustments of the modular wall or shelf component. Each counter-tab has a horizontal upper support surface 46 and a downwardly projecting counter-finger 42. The counter-fingers are positioned so as to receive finger 12 or 18 of the tabs of upper or lower brackets 8 and 16 within gap 44. FIG. 9 displays a top cross-sectional view of the two sided support plate 40 sandwiched between support posts 2 with a modular wall component 4 mounted on opposite sides of the support plate 40. With this embodiment straight walls may be erected for any particular distance.

Figure 10:
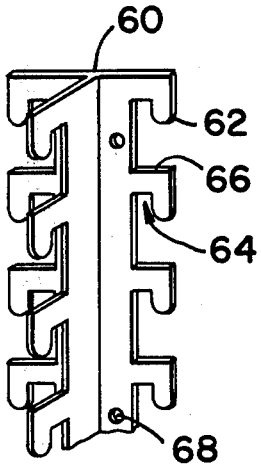
FIG. 10 is a perspective view of a three sided support plate.

A three sided support plate would be used where it is desired to erect a modular wall or shelf component in three directions. This type of plate is illustrated in FIG. 8 and 10. The support plate 60 is sandwiched between support posts 2 and end post 50. These posts are bolted together by passing bolts through holes 68 in the support plate. FIG. 8 illustrates a modular system where only two wall components 4 are inserted thereby leaving the third side for either a shelf component to be mounted or a third wall component.

Figure 11:
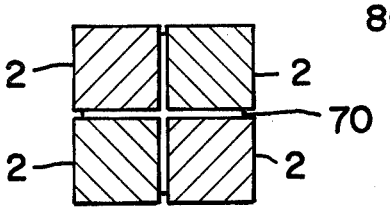
FIG. 11 is a cross-sectional top view of a four sided support plate between four support posts.
Figure 12:
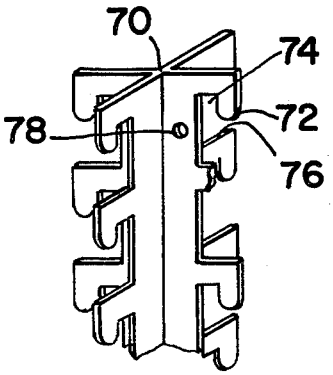
FIG. 12 is a perspective view of a four sided support plate.

FIGS. 11 and 12 illustrate another embodiment where a four sided support plate 70 is utilized. In this embodiment, the support plate 70 is sandwiched between four support posts 2. These support posts are bolted together by passing bolts through holes 78 in the support plate 70. The counter-tabs in the support plate form flat horizontal surfaces 76, counter-fingers 72 and gaps 74.

Figure 13:
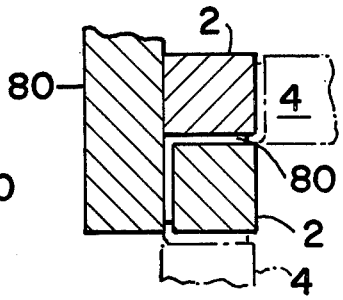
FIG. 13 is a cross-sectional top view of a two sided support plate between three support posts with two phantom wall components.

FIG. 13 is another embodiment of a two sided support plate 80. In this embodiment the sides project outwardly at right angles. The support plate 80 is mounted between two support posts 2 and end post 82.

The foregoing description of the drawings is limited to specific embodiments of the practice of this invention for purposes of illustration and example. It should be understood that numerous modifications and changes may be practiced within the scope and spirit of this invention.

UPPER BRACKET

The upper bracket of the mounting bracket means is designed to transfer substantially the entire lateral loads and a majority of the vertical loads into the support means. For this reason it is preferred to design the upper bracket to have the majority of tabs. Preferably the upper bracket extends from the top of the modular component downwardly about 60 to 95 percent of the length of the component and more preferably extending 70 to 90 percent of the length.

The shape of the tabs is not critical to the practice of this invention provided each tab has a substantially flat horizontal lower lip. As referred to herein substantially horizontal means having a slope less than 10 degrees from a true horizontal plane. A true horizontal plane is perpendicular to the force of gravity. Although the rectangular tabs are the most preferred, it is recognized that any shape can be used, such as semi-circular, triangular, etc., provided a horizontal lower lip is present.

The bracket may be constructed from any suitable material capable of supporting the design loads for the modular system. Typically metallic brackets are employed, such as, iron, steel, aluminum, etc. In some applications, plastic brackets may be utilized or combinations i.e. plastic and metallic or wood and metallic, wood and plastic, etc.

The uppermost tab has an upwardly projecting finger. This fingers extends upwardly at the end of the tab. There is a short distance between the beginning of the tab at the body portion of the bracket and the start of the upwardly projecting finger. This distance permits the downwardly projecting counter-finger of the support plate to lodge between the tab finger and body portion of the bracket. Typically, this distance is from 0.2 to 1.5 times the width of the finger and more preferably from 0.5 to 1.4 times the width of the finger.

The height of the upwardly projecting finger is designed so as to be capable of transferring the lateral forces to the support plate. Typically, this height is from 0.5 to 3 times the width and more preferably from 0.8 to 2 times the width.

The thickness of the projecting finger is typically the same thickness as the tabs although a thicker material may be employed.

The number of tabs per modular component depends upon the strength of the bracket and support means, the weight of the modular wall or shelf components and the degree of adjustments desired. Typically, there will be from 3 to 25 per foot and more usually from 8 to 15 per foot.

The body portion of the upper bracket is constructed so as to ridigidly hold the tabs in place during use and to conveniently attach to the modular wall and shelf components. The drawings illustrate a bracket body which bends perpendicular to the extended tabs. Holes through the bent portion permit the bracket to be fastened tightly against the end wall of the modular wall or shelf component. It should be apparent that the body portion may have any cross-sectional shape provided it is sturdy and may be affixed to the modular component.

LOWER BRACKET

The lower bracket is identical to the upper bracket except that it attaches to the bottom portion of the modular wall or shelf component and extends upwardly for a shorter distance. The lower bracket extends from the bottom to approximately 5 to 40 percent of the height of the modular component and preferably from 10 to 20 percent of the height. The lower bracket may have only one tab, although two or more are preferred.

The body portion of the lower bracket is the same as the body portion of the upper bracket except that it must be capable of being affixed to the modular wall or shelf component after the modular component is fully mounted to the support means. This embodiment is the locking feature of this invention. For example, FIG. 5 displays an embodiment where a lower lug is attached to the lower edge of the body portion and fits under the modular wall or shelf component. A screw passes through the lug and into the bottom edge of the modular wall or shelf component. This screw prevents the bottom portion of the modular wall from being moved away from the support means.

SUPPORT MEANS

The support means comprises any suitable upright member capable of receiving the bracket means and supporting the modular wall and shelf components. The support means can comprise a conventional slotted standard such as described in U.S. Pat. No. 3,966,158 which patent is herein incorporated by reference. The preferred support means is displayed in the drawings and described earlier. The drawings display an upright support plate having linearly aligned L-shaped counter-tabs spaced at regular intervals. The tabs of the upper and lower brackets fit between the countertabs of the support plate. The bottom lip of the tabs rest on the upper horizontal lip of the counter-tabs. The number of L-shaped counter-tabs on each support plate depends upon the desired degree of vertical adjustment and the design loads of the system. Usually, the number of counter-tabs will very from 3 to 25 per foot and more usually from 8 to 15 per foot. The length and width of the counterfingers will preferably be within the range disclosed earlier for the tab finger.

The support means provides the mechanism for assembling the various modular wall and shelf components at selected angles. A modular wall which terminates or begins will likely end or start from a one sided support means. A one sided support means refers to the number of slotted or L-shaped counter-tab support plates. A two sided support will have two slotted or L-shaped plates, a three sided support will have three and a four sided support will have four. The slotted or L-shaped plates will usually be spaced at right angles or 180 degrees, however, lesser or greater angles may be employed in other embodiments.

I claim:

1. A locking modular assembly comprising an upright support means for supporting a modular component in a substantially upright position and a mounting bracket means connected to said modular component along a vertical plane extending from the top to the bottom of said modular component for adjustably affixing said modular component to said support means; said mounting bracket means comprising:

(a) an upper bracket member having an elongated body portion constructed to be connected to the upper portion of said modular component, and a plurality of linearly aligned first tabs extending outwardly from said body portion, said tabs having a substantially horizontal lower lip to support the vertical load of said modular component and having an outwardly upper lip on all tabs except the uppermost tab, said uppermost tab having a horizontal lower lip and an upwardly projecting finger on the upper lip adapted to communicate with said upright support means to prevent lateral displacement of the top portion of said modular component;

(b) a lower locking bracket member having a shortened second body portion and at least one linearly aligned second tab extending outwardly from said shortened body portion, the uppermost second tab having a substantially horizontal lower lip and an upper lip with upwardly projecting finger adapted to communicate with said upright support means to prevent lateral displacement of said lower locking bracket member, said second body portion being constructed to to be connected to the lower portion of said modular component thereby locking said modular component to said upright support means.

2. The locking modular assembly defined in claim 1 wherein said upright support means is a slotted standard.

3. The locking modular assembly defined in claim 1 wherein said upright support means comprises an upright support plate having evenly disposed, linearly aligned, L-shaped, counter-tabs extending outwardly from said support plate and constructed so as to receive said tabs from said mounting bracket means, each of said counter-tabs having (1) a downwardly extending counter-fingers constructed to be engagable with the upwardly extending finger of said uppermost tabs and (2) a horizontal upper lip adapted to receive the horizontal lower lip of said tabs in said mounting bracket means.

4. The locking modular assembly defined in claim 3 wherein said upright support means has from one to four sides, each side having said linearly aligned L-shaped counter-tabs.

5. The locking modular assembly defined in claim 4 wherein said body portion of said lower bracket member has a lower lug adapted to be attached to the bottom of said modular component.

6. The locking modular assembly defined in claim 3 wherein said upright support plate is sandwiched between at least two support posts.

7. A locking modular assembly comprising an upright support means for supporting a modular component in a substantially upright position, and a mounting bracket means connected to said modular component along a vertical plane extending from the top portion to the bottom portion of said modular component for adjustably affixing said modular component to said upright support means;

said mounting bracket means comprising (a) an upper bracket member having an elongated body portion connected to the upper portion of said modular component and a plurality of linearly aligned first rectangular tabs extending outwardly in a common plane from said elongated body portion, the uppermost tab having an upwardly projecting finger on the upper lip adapted to communicate with said upright support means to prevent lateral displacement of said upper portion of said modular component, (b) a lower bracket member having a shortened body portion and a plurality of linearly aligned second rectangular tabs extending outwardly in a common plane from said shortened body portion, the uppermost second tab having an upwardly projecting finger on the upper lip adapted to communicate with said upright support means to prevent lateral displacement of said lower bracket member, said shortened body portion having an extending lug being connected to the bottom of said modular component to lock said modular component to said upright support means;

said upright support means comprising an upright support plate having evenly disposed linearly aligned L-shaped counter-tabs extending outwardly from said support plate and constructed to receive said tabs from said mounting bracket means, each of said counter-tabs having (1) a downwardly extending counter-finger constructed on the lower lip engagable with the upwardly extending finger of said uppermost tabs and (2) a horizontal upper lip adapted to receive the horizontal lower lip of said tabs in said mounting bracket means, said support plate being sandwiched between at least two support posts to prevent transverse displacement of said mounting bracket means.

8. The locking modular assembly defined in claim 7 wherein said lower bracket member has two tabs.

* * * * *